US009676020B2

(12) United States Patent
Wang

(10) Patent No.: US 9,676,020 B2
(45) Date of Patent: Jun. 13, 2017

(54) TROUGH-FORM FINE BLANKING DEVICE

(71) Applicant: Cheng-Ping Wang, Keelung (TW)

(72) Inventor: Cheng-Ping Wang, Keelung (TW)

( * ) Notice: Subject to any disclaimer, the term of this patent is extended or adjusted under 35 U.S.C. 154(b) by 0 days.

(21) Appl. No.: 14/451,036

(22) Filed: Aug. 4, 2014

(65) Prior Publication Data

US 2015/0122101 A1 May 7, 2015

(30) Foreign Application Priority Data

Nov. 5, 2013 (TW) ..... 102140026 A
May 9, 2014 (TW) ..... 103116598 A

(51) Int. Cl.
*B21D 28/16* (2006.01)
*B21D 28/14* (2006.01)
*B21D 22/22* (2006.01)

(52) U.S. Cl.
CPC ..... *B21D 28/16* (2013.01); *B21D 28/14* (2013.01); *B21D 22/22* (2013.01); *Y10T 83/9425* (2015.04)

(58) Field of Classification Search
CPC .... B21D 22/10; B21D 26/023; B21D 26/029; B21D 26/031; B21D 28/14; B21D 28/145; B21D 28/16; B21D 28/18; B21D 45/003; B21D 35/001; B21D 35/002
USPC ..... 72/41, 43–45, 54–57, 60, 324–339; 83/40, 55, 169, 685
See application file for complete search history.

(56) References Cited

U.S. PATENT DOCUMENTS 2,821,156 A * 1/1958 Lyon ..... 72/43
3,554,065 A * 1/1971 Kunz ..... B21D 28/16 83/124
3,664,172 A * 5/1972 Cvacho ..... 72/350
3,732,762 A * 5/1973 Plumb ..... 83/98
3,789,649 A * 2/1974 Clowes ..... 72/350
4,586,360 A * 5/1986 Jurgensmeyer et al. ..... 72/328
4,833,903 A * 5/1989 de Smet ..... 72/57
5,572,896 A * 11/1996 Story ..... 72/350
5,722,280 A * 3/1998 Bodnar ..... B21D 28/36 72/186

(Continued)

FOREIGN PATENT DOCUMENTS

EP 0848099 A1 6/1998
EP 2036631 A1 3/2009
EP 2610019 A1 7/2013

OTHER PUBLICATIONS

European Search Report dated Mar. 18, 2015 for counterpart European patent application 14179319.0.

*Primary Examiner* — Peter DungBa Vo
*Assistant Examiner* — Joshua D Anderson
(74) *Attorney, Agent, or Firm* — Birch, Stewart, Kolasch & Birch, LLP

(57) ABSTRACT

A fine blanking device characterized by a trough structure is provided. Preferably, the fine blanking device comprises a punch, a mother die module having a first die cavity allowing the punch to enter therein, and a blank-holder module having a second die cavity allowing the punch to enter therein; wherein one or more trough structures are formed on/individually formed on the mother die module or/and the blank-holder module, wherein the trough structure is formed, surrounding the first die cavity, on the mother die module at a sheet stock contacting side thereof; or/and the trough structure is formed, surrounding the second die cavity, on the blank-holder module at a sheet stock contacting side thereof.

11 Claims, 14 Drawing Sheets

(56) References Cited

U.S. PATENT DOCUMENTS

| | | | | |
|---|---|---|---|---|
| 5,755,129 | A * | 5/1998 | Yamasaki | 72/57 |
| 6,033,499 | A * | 3/2000 | Mitra | 148/688 |
| 6,196,043 | B1 * | 3/2001 | Ehardt | B21D 22/22 72/350 |
| 6,539,767 | B2 * | 4/2003 | McClung | 72/336 |
| 7,313,939 | B2 * | 1/2008 | Nobata | 72/57 |
| 7,634,857 | B2 * | 12/2009 | Ueki et al. | 29/893.34 |
| 8,056,384 | B2 * | 11/2011 | Schwenk | B21D 22/02 72/348 |

* cited by examiner

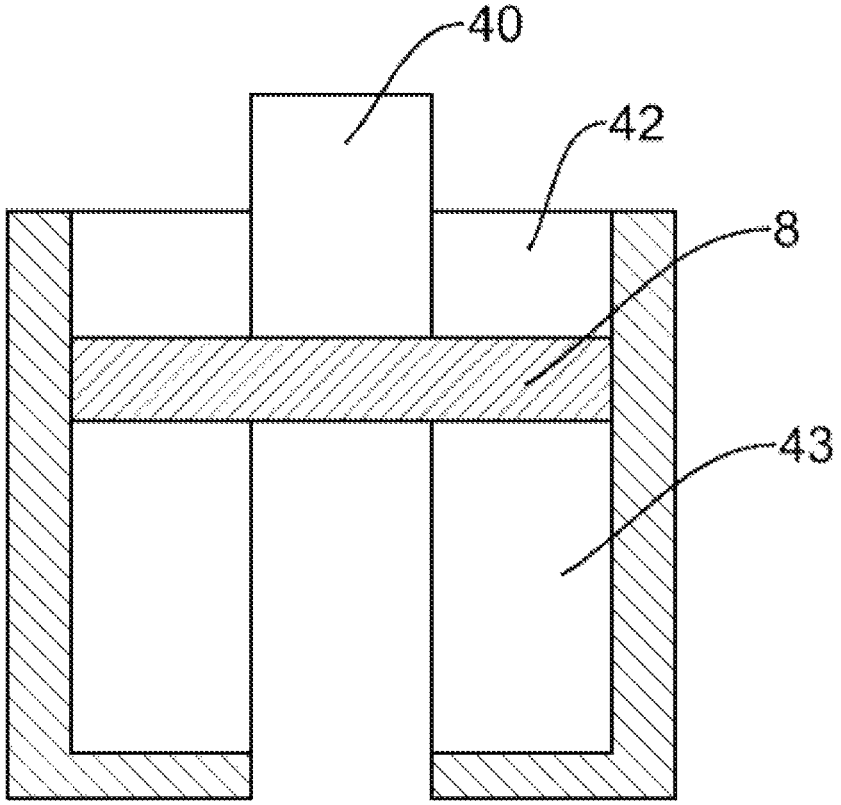
Figure 10（Prior Art）

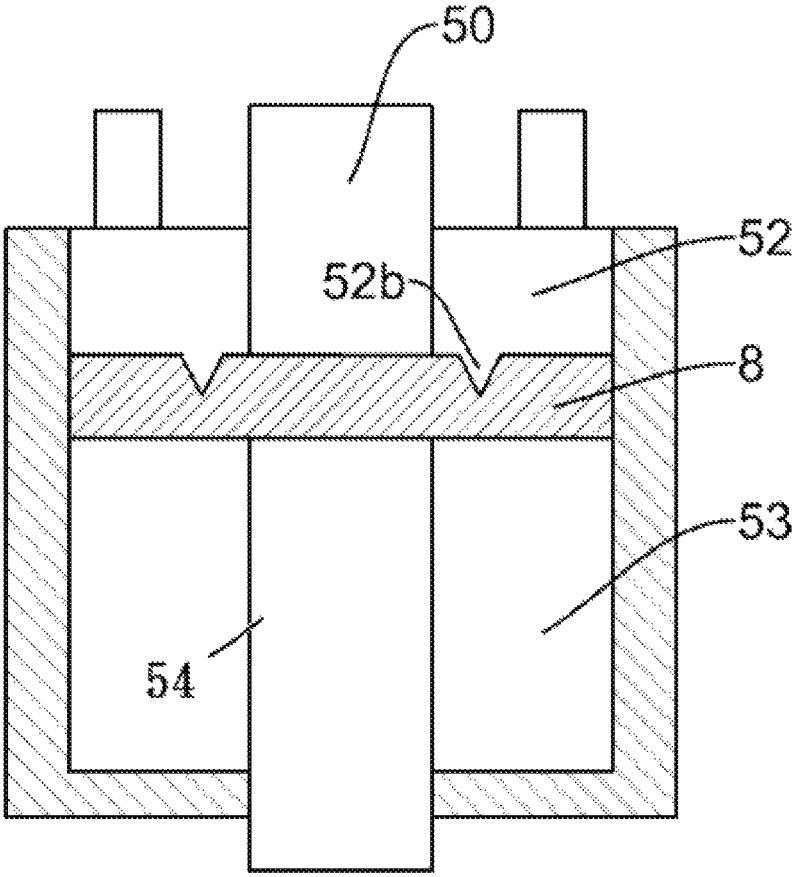
Figure 11（Prior Art）

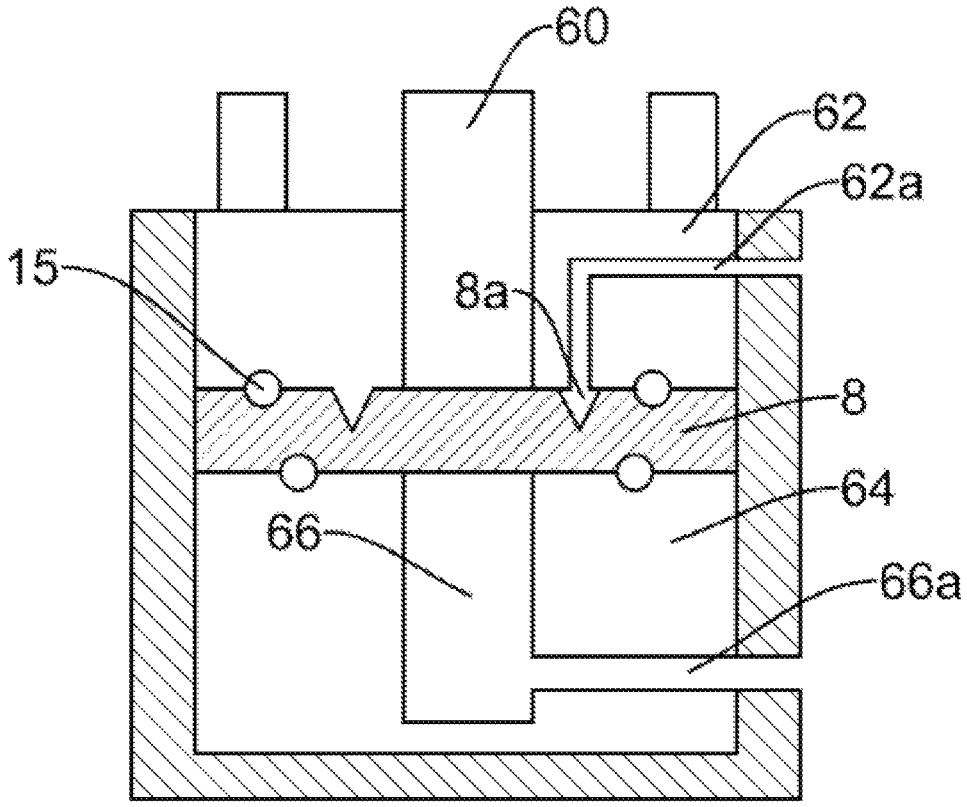
Figure 12（Prior Art）

TROUGH-FORM FINE BLANKING DEVICE

FIELD OF THE INVENTION

The present invention relates to a fine blanking device, and more particularly to a fine blanking device which may enhance or improve the burnish length, burr, sunk angle and roll-over of the blanked products.

BACKGROUND OF THE INVENTION

The blanking process plays an essential role in production and processing and is applied widely in manufacturing industries such as electronic product panels, mobile phone casings, terminals, metal gears, sheet metal cutting, metal tools (e.g., wrench and screwdriver), vehicle housings, sheet metal, wheel rims, etc. As shown in FIG. 10 (prior art), the structure of conventional blanking device/system is simple and comprises a punch 40, a blank holder 42, a die 43 and a sheet stock 8. The burnish length of blanked product from a conventional blanking device/system is about 30%-50% of the total blank thickness, which is not acceptable for products required 100% burnish length. To address this problem, a fine blanking device was invented by Fritz Schiess (Germany patent number 371004 filed in 1922) and has been used until today. As shown in FIG. 11 (prior art), compared to the dies for conventional blanking, the dies for fine blanking have a V-shaped ring 52*b* disposed on the blank holder 52 (the "upper die"). The conventional fine blanking device of FIG. 11 also comprises a punch 50, a die 53 (the "bottom die" or "mother die"), and an ejector chamber 54. The V-shaped ring is to reduce the fracture zone by increasing the hydrostatic pressure at the area on both sides of the sheet stock around the cutting edge of the punch or the mother die. Although conventional fine blanking process can reduce fracture zone (by around 80%-90% burnish length), the remaining 10-20% fracture zone with sunk angles and roll-overs seriously affects the quality of blanked products. Furthermore, the V-shaped ring used in the conventional fine blanking pierces into the product during the fine blanking process and many problems are thus arisen. For example: (1) rings with complex configuration other than a circular one are difficult to manufacture; therefore conventional fine blanking is not applicable to the blanking of products with complex configuration; (2) the difficulty in maintenance: fractures of V-shaped ring which occur due to stress concentration after thousands of blanking require repairs and result in higher maintenance cost; (3) for blanking of sheet stock with larger area, even circular V-shaped ring is difficult to manufacture and maintain; and a V-shaped ring cannot be pressed into the sheet material too deep due to its wedge-shape in nature, and thus conventional fine blanking is not applicable to thicker sheet stock (e.g., more than 10 mm in thickness), greatly restricting the application of conventional fine blanking.

Taking high precision three-lobe pumps and cycloid-shaped gears, and commonly used thicker spur gear as examples, these products cannot be manufactured using conventional fine blanking. FIG. 12 (prior art) shows a prior art (Int. J. Adv. Manuf. Technol. (2013 68:2761-2769)) aiming at improving conventional fine blanking by forming a V-shaped cavity 8*a* on a sheet stock 8, and then applying a hydraulic pressure through a hydraulic runner 62*a* of a blank holder 62. The fine blanking system of FIG. 12 also comprises a punch 60, a back pressure chamber 66, a hydraulic runner 66*a* and a mother die module 64. A means for sealing 15 is disposed between the sheet stock 8 and the blank holder 62. A means for sealing 15 is also disposed between the sheet stock 8 and the mother die module 64. Using the hydraulic pressure applied to the V-shaped cavity 8*a* to replace the V-shaped ring makes the control of the pressure possible. Although this prior art improves the conventional fine blanking in several aspects, such as reducing die production and maintenance costs and being applicable to thicker and complex products, the V-shaped cavity 8*a* makes the sheet stock 8 difficult to be constrained by the blank holder 62. Therefore, the problems of sunk angles and roll-overs still remain.

In view of the foregoing, it is urgently desired in this industry to develop a fine blanking device which is applicable for mass production without cost increase, and is applicable to thicker or larger and various complex configuration sheet stocks and in the same time reduces the sunk angles and roll-overs.

SUMMARY OF THE INVENTION

Accordingly, the present invention provides a fine blanking device/system characterized in the design of a trough structure, which can achieve the production of a blanked product with improved burnish length for a sheet stock having higher thickness and/or larger cutting area and without burrs, sunk angles and roll-overs in one blanking operation. On the other hand, the present invention of fine blanking device may further comprise V-shaped ring, sheet stock trough, back pressure module and/or means for sealing known in the art to further enhance the functionality of the fine blanking device of the present invention.

The present invention provides a fine blanking device for blanking a sheet stock, which comprises a mother die module and a blank-holder module. The mother die module has a first die cavity, and the blank-holder module has a second die cavity. Each of the first and second die cavities allows a punch to enter therein. The fine blanking device is characterized in that a trough structure is formed on the mother die module and/or the blank-holder module, wherein the trough structure is formed, surrounding the first die cavity, on the mother die module at a sheet stock contacting side thereof; and/or the trough structure is formed, surrounding the second die cavity, on the blank-holder module at a sheet stock contacting side thereof.

More specifically, this invention provides a fine blanking device for blanking a sheet stock, comprising a punch, a mother die module having a first die cavity allowing the punch to enter therein, and a blank-holder module having a second die cavity allowing the punch to enter therein, wherein one or more trough structures are formed on/individually formed on the mother die module or/and the blank-holder module, wherein the trough structure is formed, surrounding the first die cavity, on the mother die module at a sheet stock contacting side thereof, or/and the trough structure is formed, surrounding the second die cavity, on the blank-holder module at a sheet stock contacting side thereof.

According to certain embodiments of the present invention, the fine blanking device may further comprise a V-shaped ring disposed relatively to the trough structure on the blank-holder module or the mother die module, wherein the V-shaped ring is disposed, surrounding the first die cavity, on the mother die module at a sheet stock contacting side thereof, or the V-shaped ring is disposed, surrounding the second die cavity, on the blank-holder at a sheet stock contacting side thereof.

According to certain embodiments of the present invention, the fine blanking device may further comprise a sheet stock trough. The sheet stock trough is formed, relatively to the trough structure, on the sheet stock at an upper side or a lower side thereof, allowing the punch to pass through an area where the sheet stock trough surrounded, wherein the sheet stock trough may be applied with a hydraulic pressure.

In one embodiment of the present invention, the fine blanking device further comprises a means for sealing disposed between the sheet stock and the mother die module and/or the sheet stock and the blank-holder module.

According to another embodiment of the present invention, the fine blanking device further comprises a back pressure module for generating a back pressure, the back pressure being acting on a bottom side of the sheet stock.

According to certain specific embodiments of the present invention, the trough structure further includes a filler module disposed therein.

BRIEF DESCRIPTION OF THE DRAWINGS

The foregoing summary, as well as the following detailed description of the invention, will be better understood when read in conjunction with the appended drawing. In the drawings:

FIG. 10 shows a schematic cross-sectional view of a conventional blanking device.

FIG. 11 shows a schematic cross-sectional view of a conventional fine blanking device.

FIG. 12 shows a schematic cross-sectional view of another conventional fine blanking device.

DESCRIPTION OF THE INVENTION

Figure 1:
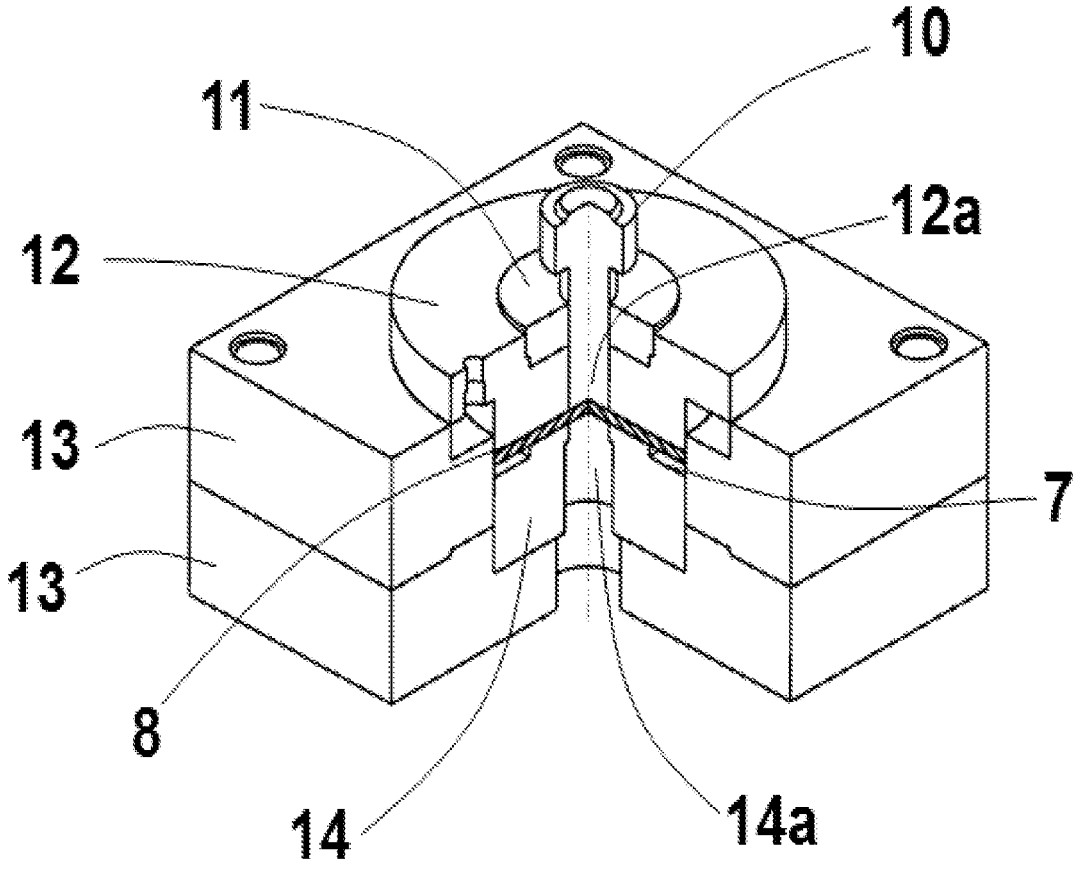
FIG. 1 shows a perspective view of a fine blanking device in accordance with an embodiment of the present invention.

Unless defined otherwise, all technical and scientific terms used herein have the same meaning as commonly understood by a person skilled in the art to which this invention belongs.

As used herein, the singular forms "a", "an", and "the" include plural referents unless the context clearly dictates otherwise. Thus, for example, reference to "a sample" includes a plurality of such samples and equivalents thereof known to those skilled in the art.

Through the design of a trough structure, the fine blanking device of the present invention can achieve the production of a blanked product with improved burnish length for a sheet stock having higher thickness and/or larger cutting area and without burrs, sunk angles and roll-overs.

Accordingly, the present invention provides a fine blanking device for blanking a sheet stock, which comprises a mother die module and a blank-holder module, and is characterized in a trough structure formed on the mother die module and/or the blank-holder module. The mother die module has a first die cavity penetrated therethrough. Similarly, the blank-holder module has a second die cavity penetrated therethrough. Each of the first and second die cavities allows a punch to enter therein. According to the invention, a trough structure is formed on the mother die module and/or the blank-holder module for achieving at least the above-mentioned objectives. When forming on the mother die module, the trough structure is formed at a side of the mother die module where it contacts with the sheet stock and is in a form that surrounds the first die cavity. When forming on the blank-holder module, the trough structure is formed at a side of the blank-holder module where it contacts with the sheet stock and is in a form that surrounds the second die cavity. More specifically, this invention provides a fine blanking device for blanking a sheet stock, comprising a punch, a mother die module having a first die cavity allowing the punch to enter therein, and a blank-holder module having a second die cavity allowing the punch to enter therein, wherein one or more trough structures are formed on/individually formed on the mother die module or/and the blank-holder module, wherein the trough structure is formed, surrounding the first die cavity, on the mother die module at a sheet stock contacting side thereof, or/and the trough structure is formed, surrounding the second die cavity, on the blank-holder module at a sheet stock contacting side thereof.

It goes without saying that the fine blanking device of the invention may also comprise one or more blanking device modules/elements known in the art, including but not limited to a V-shaped ring, a sheet stock trough, a back pressure module, and a means for sealing. Further, in a preferred embodiment of the present invention, the trough structure further includes a filler module disposed therein. Functionally, the trough structure may at least replace the V-shaped ring used in conventional fine blanking device, by increasing the hydrostatic pressure on either or both sides of the sheet stock at an area around the cutting edge of the punch or the mother die module. This prevents the negative effects of V-shaped ring and even better, further improves the quality of blanked products. A back pressure module may be incorporated into the fine blanking device of the invention to further prevent sunk angles and roll-overs of the blanked products. In the case of the back pressure being a hydraulic or air pressure, the first die cavity of the mother die module may also serve as a back-pressure chamber. If only long burnish length is concerned, a person skilled in the art would recognize that the fine blanking device of the present invention can work fine and normally without a back pressure module.

The term "trough structure" as used herein refers to a trough-, concave-, or ladder-shape structure formed on a mother die module and/or a blank-holder module of the fine blanking device of the present invention. A trough structure may be formed on either the mother die module or the blank-holder module or on both of which. When forming on the mother die module, the trough structure is formed at a side of the mother die module where it contacts with the sheet stock and is in a form that surrounds a first die cavity of the mother die module. When forming on the blank-holder module, the trough structure is formed at a side of the blank-holder module where it contacts with the sheet stock and is in a form that surrounds a second die cavity of the blank-holder module. The configuration of a trough structure configuration is not limited herein. A person having ordinary skill in the art can readily determine an appropriate configuration, e.g., U shaped or V shaped trough structure. Neither the surrounding shape of the trough structure that it surrounds the first or second die module is limited herein. A person having ordinary skill in the art can readily determine an appropriate shape suitable for a specific product. Preferably, the shape may be circular or a shape that corresponds to the shape of the product. The trough structure may be formed at the edge of the sheet stock contacting side of the mother die module or the blank-holder module (as shown in FIG. 1*a* and FIG. 2*a*). The trough structure may also be formed at an appropriate position between the edge and the outlet of the first or second die cavity. In summary, what is required is a space surroundingly formed on a mother die module and/or a blank-holder module at its sheet stock contacting side.

The mother die (also known as the "bottom die") and the blank holder (also known as the "upper die") are essential and known modules/elements for a blanking device. The "mother die module" in the present invention corresponds to the mother die, and the blank-holder module in the present invention corresponds to the blank holder.

The fine blanking device of the present invention may further comprise a filler module disposed in the trough structure. The filler module can be of hydraulic pressure type, air pressure type, spring, O ring, soft material, hard material, etc. A filler module may keep pressure in the trough structure uniform and further improves the quality of blanked products. On the other hand, in the case that a hydraulic or air pressure is applied through the mother die module (e.g., hydraulic or air pressure generated by a back pressure module), a means for sealing may be required at certain locations of the fine blanking device. The means for sealing is used to seal possible oil leaks to prevent insufficient oil pressure which may cause an accident. For example, a means for sealing for use in the invention includes but is not limited to an O ring, a bearing seal, an oil seal, a hydraulic seal, and various mechanical seals.

Figure 1A:
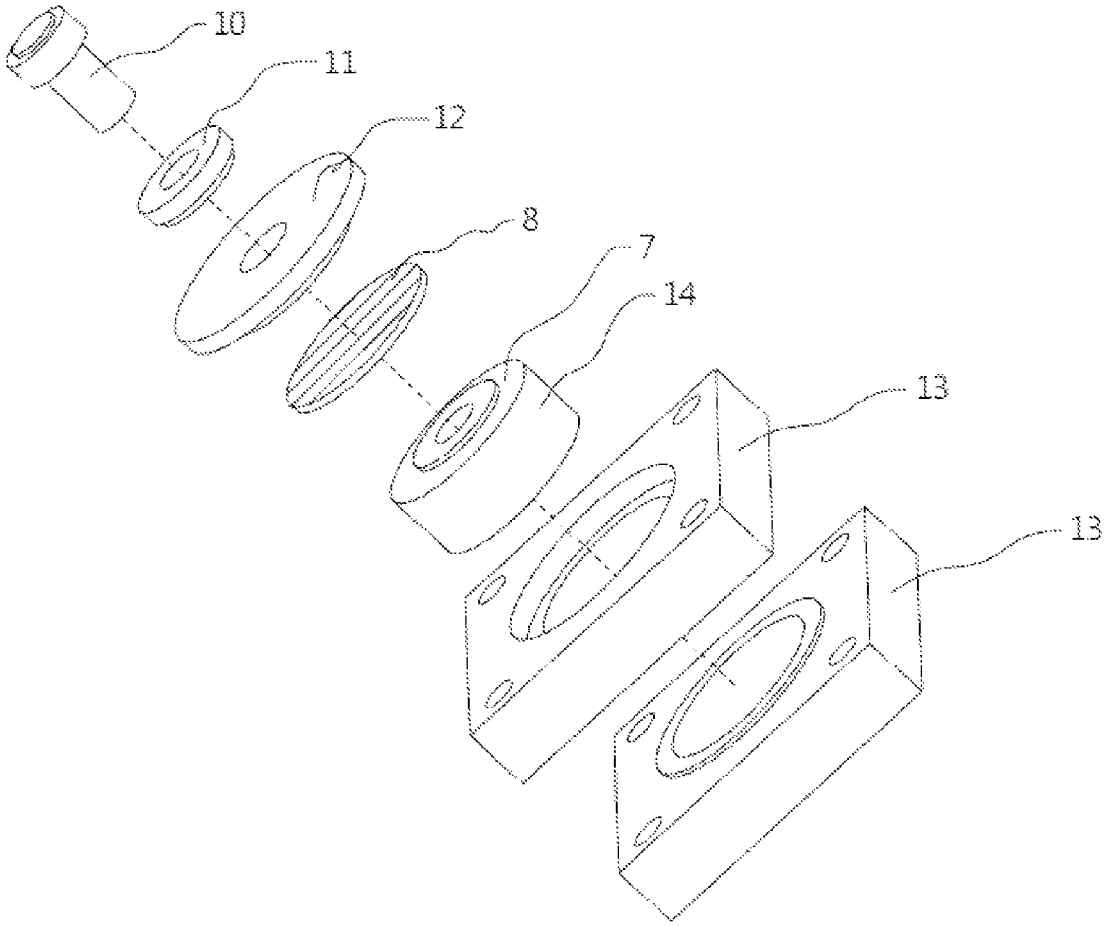
FIG. 1*a* shows an exploded view of a fine blanking device in accordance with said embodiment of the present invention.

FIG. 1 shows a perspective view of a fine blanking device in accordance with one embodiment of the present invention. FIG. 1*a* shows an exploded view of the fine blanking device in accordance with said embodiment of the present invention.

Figure 2:
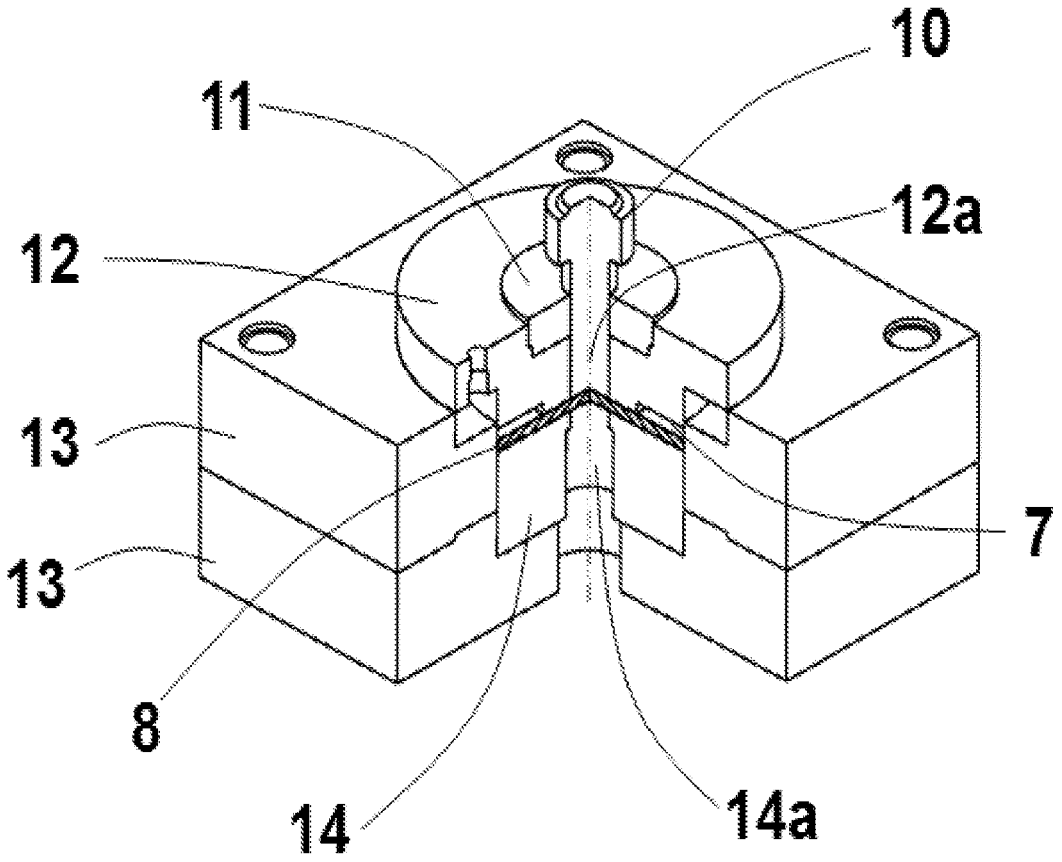
FIG. 2 shows a perspective view of a fine blanking device in accordance with another embodiment of the present invention.
Figure 2A:
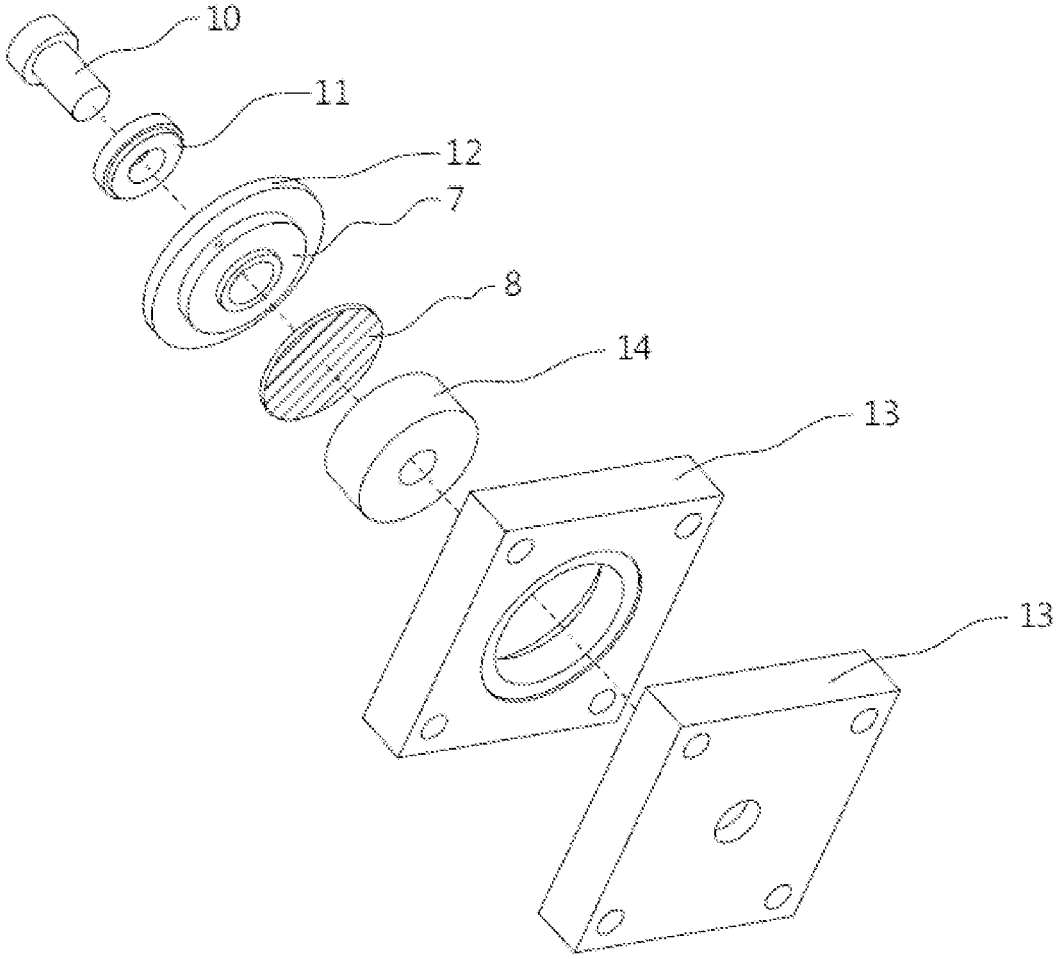
FIG. 2*a* shows an exploded view of a fine blanking device in accordance with said embodiment of the present invention.

FIG. 2 shows a perspective view of a fine blanking device in accordance with another embodiment of the present invention. FIG. 2*a* shows an exploded view of the fine blanking device in accordance with said embodiment of the present invention.

Figure 3:
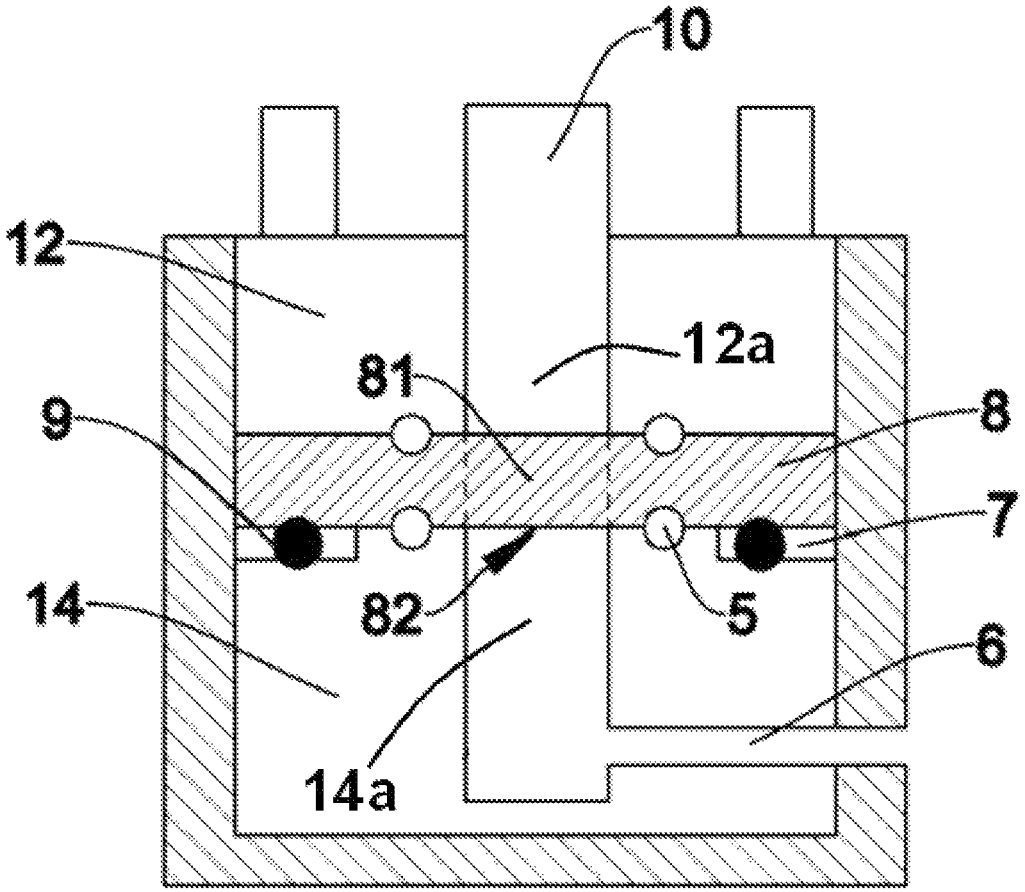
FIG. 3 shows a schematic cross-sectional view of a fine blanking device in accordance with one embodiment of the present invention.
Figure 4:
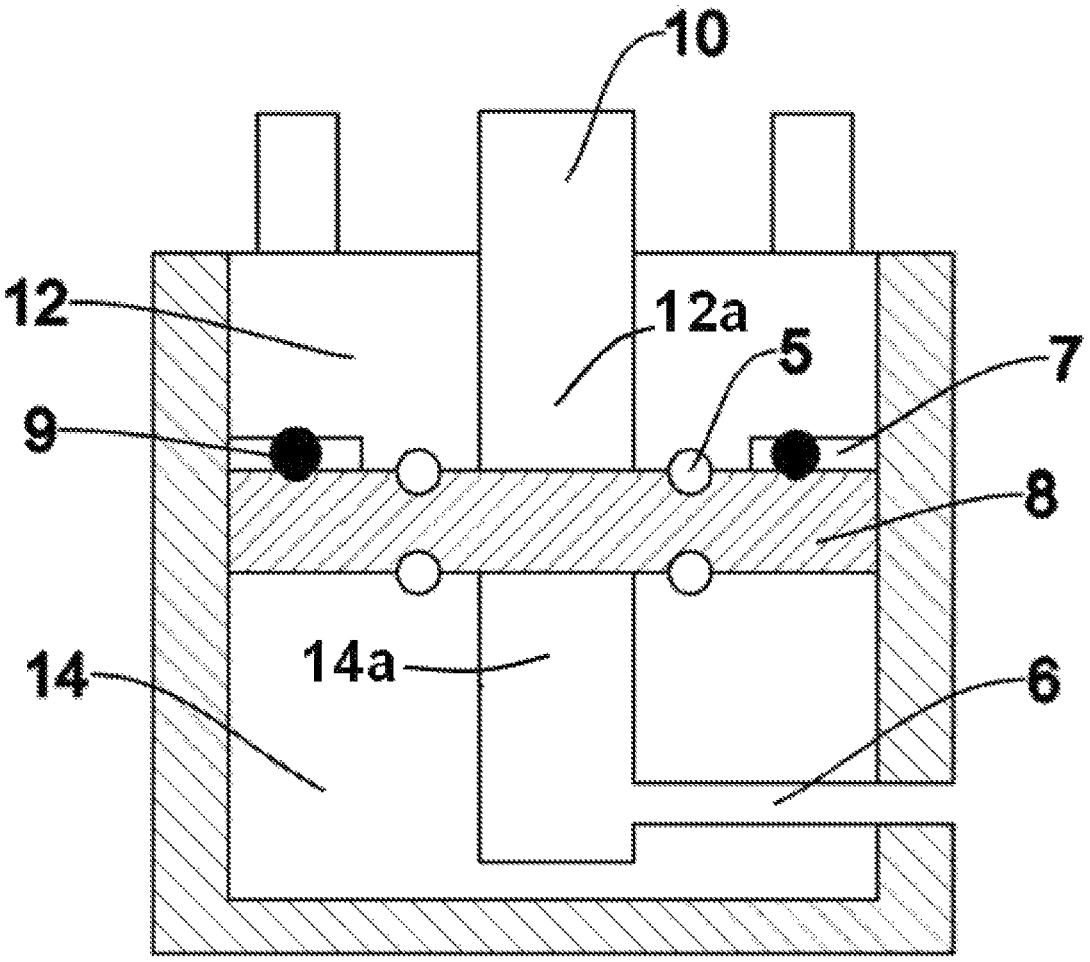
FIG. 4 shows a schematic cross-sectional view of a fine blanking device in accordance with one embodiment of the present invention.
Figure 5:
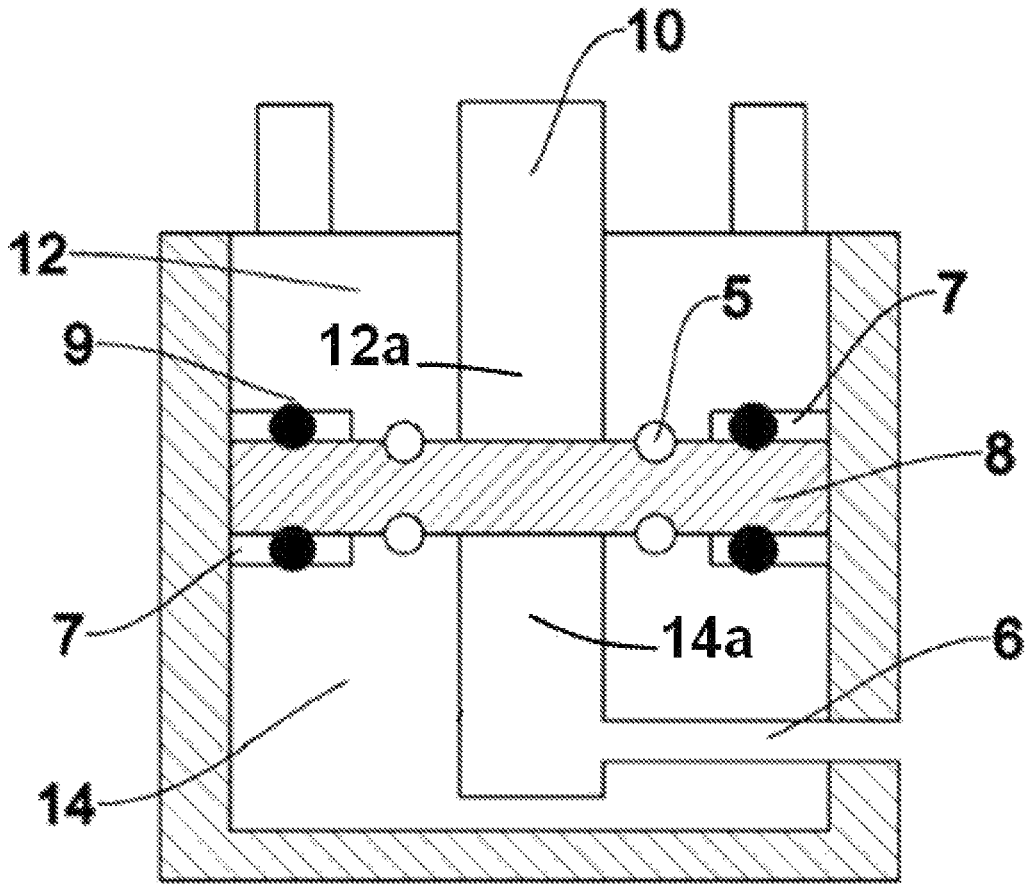
FIG. 5 shows a schematic cross-sectional view of a fine blanking device in accordance with a one embodiment of the present invention.

Referring to FIGS. 1-5, shown in each is a fine blanking device of the present invention comprises a punch 10, a punch guiding module 11, a blank-holder module 12, a die holder 13, and a mother die module 14. The blank-holder module 12 has a second die cavity 12*a* penetrated therethrough. The punch 10 passes through the second die cavity 12*a* to contact with and punch on a sheet stock 8 in the guidance of the punch guiding module 11. The mother die module 14, having a first die cavity 14*a*, is disposed within the die holder 13. The fine blanking device may further comprise a back pressure module 6 (as shown in FIGS. 3-5; in the present embodiments the back pressure module 6 is a runner device through which a hydraulic or air pressure is applied) configured in the mother die module 14. The first die cavity 14*a* may also serve as a back-pressure chamber, in combination with the back pressure module 6 becoming a back-pressure/ejector system. According to the present invention, a trough structure 7 is formed on the mother die module 14 and/or the blank-holder module 12. In other words, the trough structure 7 may be formed either on the mother die module 14 (as shown in FIGS. 1 and 3) or on the blank-holder module 12 (as shown in FIGS. 2 and 4), or the trough structure 7 may be individually formed on both the mother die module 14 and the blank-holder module 12 (as shown in FIG. 5). In addition, a filler module 9 may be further included and dispose in the trough structure 7 to keep the pressure therein uniform when the blank-holder module 12 is compressing downward. In other embodiments, a back pressure module 6 and/or a means for sealing 5 may be further included in the fine blanking device of the present invention. With reference to FIGS. 3-5, it can be seen that the function of V-shaped ring used in conventional fine blanking device is replaced by the trough structure 7. The trough structure 7 can increase the hydrostatic pressure on either or both sides of the sheet stock at the area around the cutting edges of the punch and the mother die module, and can thus reduce the fracture zone. A pressure may be apply to the bottom side 82 (as shown in FIG. 3) of the sheet stock 8 through the back pressure module 6 by hydraulic pressure, spring system or other pressure generating system to increase the hydrostatic pressure on the bottom side of the sheet stock 8 at an area around the cutting edge(s) of the mother die module, further reducing the sunk angles and roll-overs. The back pressure module 6 may also serve as a blanking discharging/ejector system. Further, a means for sealing 5 may be used to seal possible oil leaks to prevent insufficient oil pressure which may lead to an accident.

FIG. 3 provides a schematic cross-sectional view of a fine blanking device in accordance with a certain embodiment of the invention, wherein the trough structure is formed on the mother die module, and the fine blanking device further comprises other additional modules/elements. The fine blanking device comprises a blank-holder module 12, a punch 10, a mother die module 14, and a trough structure 7, and further comprises a filler module 9, a back pressure module 6, and a means for sealing 5. As shown in FIG. 3, a user may manipulate the punch 10 to pass through a second die cavity 12*a* of the blank-holder module 12 to contact with and punch on the sheet stock 8. The user keeps manipulating the punch 10 to compress downward and blank the sheet stock 8, resulting in separation of a blanked product 81 from the sheet stock 8. Accordingly, the blanked product 81 will have a shear surface profile/cross-sectional profile corresponding to the cross-sectional profile of the punch 10. The mother die module 14 is engraved to form a trough structure 7 thereon. A means for sealing 5 is disposed between the mother die module 14 and the sheet stock 8. When the blank-holder module 12 compresses downward, the sheet stock 8 will be squeezed into the trough structure 7, and there will be great hydrostatic pressure between the cutting edge(s) of the mother die module 14 and the sheet stock 8. With or without the further aid of a back pressure applied to the bottom side 82 of the sheet stock 8, the fractures at the lower edge of the product can be significantly reduced. In addition, a filler module 9 may be disposed in the trough structure 7 to keep pressure uniform therein when the blank-holder module 12 compresses downward.

In FIG. 4 shown is a schematic cross-sectional view of another embodiment of the invention, wherein the trough structure is formed on the blank-holder module. When the blank-holder module 12 compresses downward, the sheet stock 8 will be squeezed into the trough structure 7, and there will be great hydrostatic pressure between the cutting edge(s) of the blank-holder module 12 and the sheet stock 8. With or without the further aid of a back pressure applied to the bottom side of the sheet stock 8, the fractures at the lower edge of the product nearing the cutting edge(s) of the mother die module can be significantly reduced. A back pressure module 6 and/or a means for sealing 5 may be further included. In addition, a filler module 9 may be disposed in the trough structure 7 to keep pressure uniform therein when the blank-holder module 12 compresses downward.

FIG. 5 illustrates another embodiment of the present invention. According to this embodiment, the fine blanking device has two trough structures. One is formed on the blank-holder module 12 and the other is formed on the mother die module 14. The two trough structures 7 are able to result in high hydrostatic pressure on both sides of the sheet stock 8. With or without the further aid of a back pressure applied to the bottom side of the sheet stock 8, the fractures at both the upper and lower edges of the product can be significantly reduced. Likewise, a back pressure module 6, a means for sealing 5, and/or a filler module 9 may be further included. The first die cavity 14*a* may serve as a back-pressure chamber, in combination with the back pressure module 6 becoming a back-pressure/ejector system.

Figure 6:
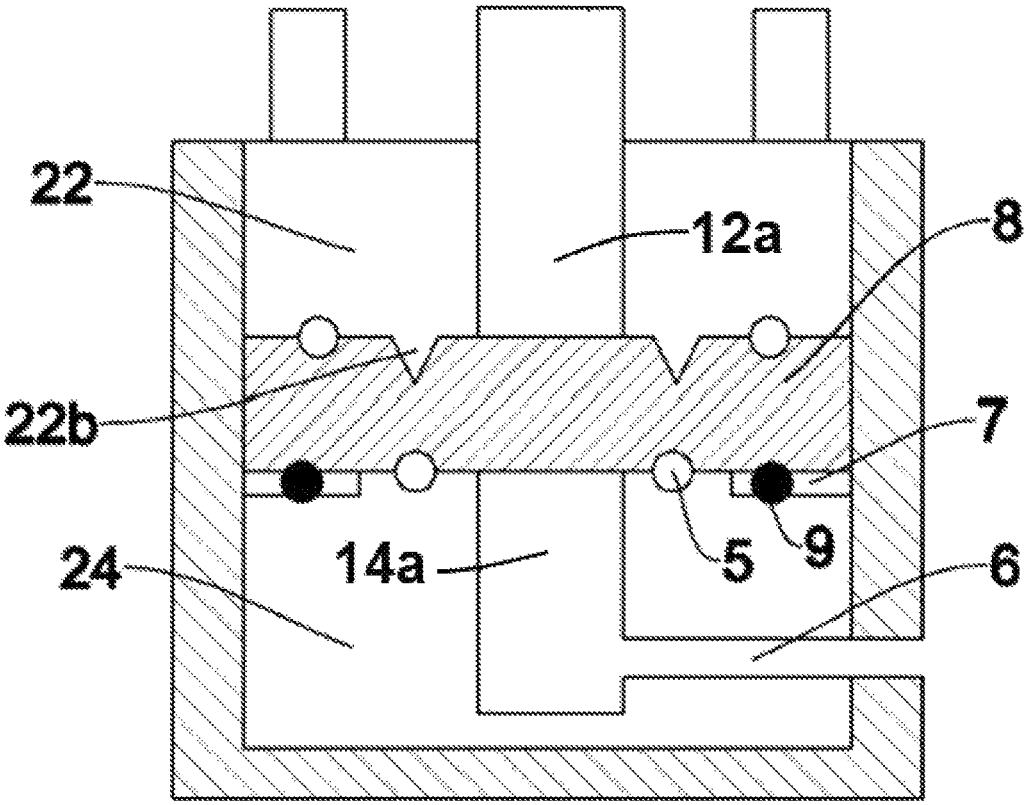
FIG. 6 shows a schematic cross-sectional view of a fine blanking device in accordance with another embodiment of the present invention.
Figure 7:
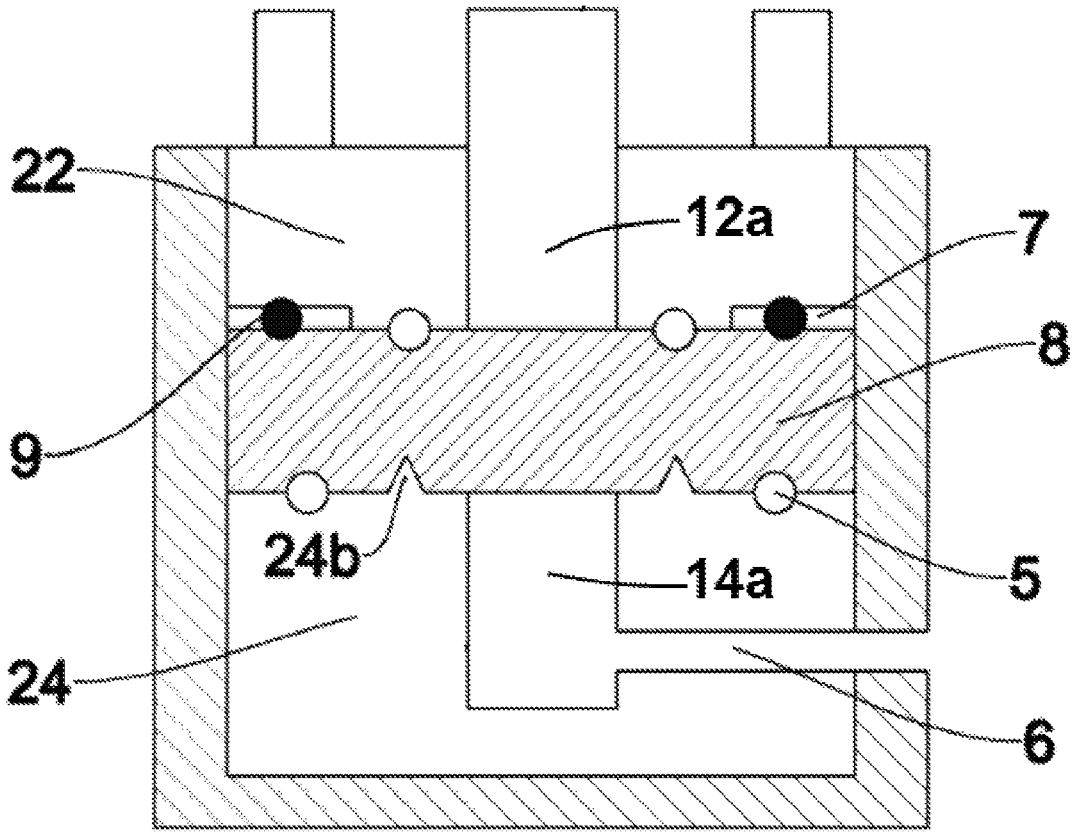
FIG. 7 shows a schematic cross-sectional view of a fine blanking device in accordance with a still another embodiment of the present invention.

In certain embodiments of the present invention, a V-shaped ring 22*b* is further included and disposed on a blank-holder module 22, relatively to a trough structure 7 (as shown in FIG. 6). Otherwise, a V-shaped ring 24*b* may be disposed on a mother die module 24, relatively to a trough structure 7 (as shown in FIG. 7). Of course, a back pressure module 6 and/or a means for sealing 5 may also be added to such embodiments. Further, a filler module 9 may be disposed in the trough structure 7 to keep pressure uniform therein when the blank-holder module 12 compresses downward.

Figure 8:
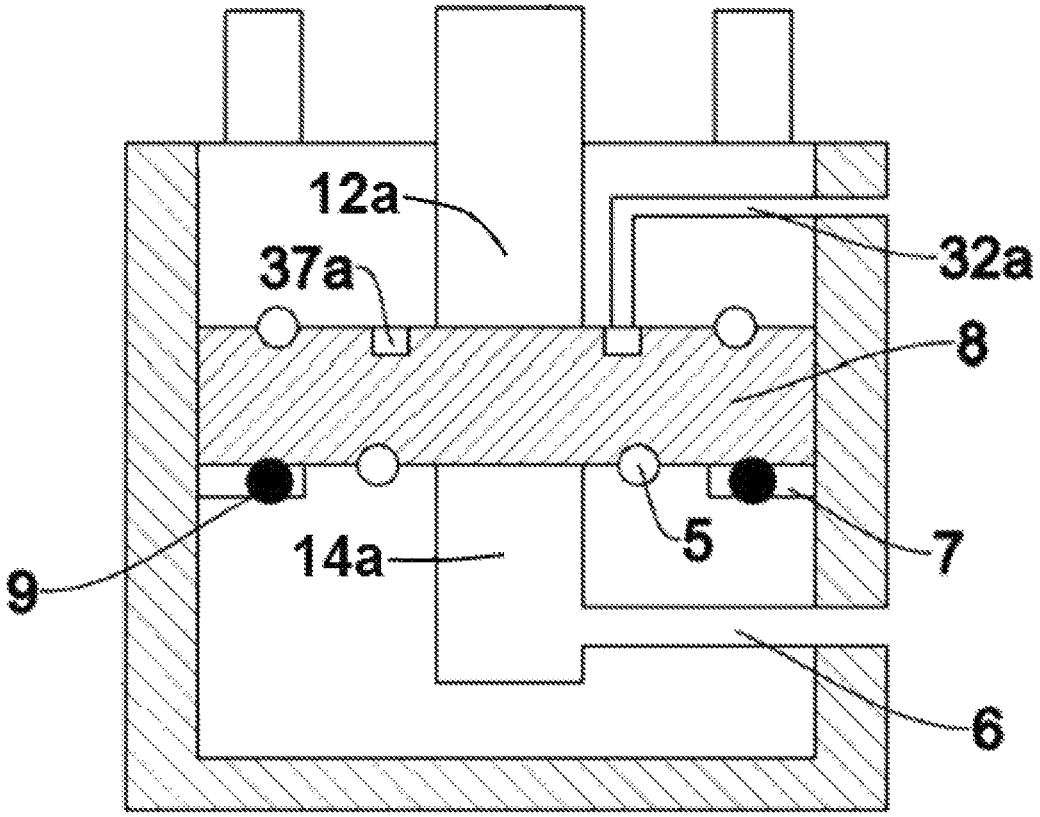
FIG. 8 shows a schematic cross-sectional view of a fine blanking device in accordance with one embodiment of the present invention.
Figure 9:
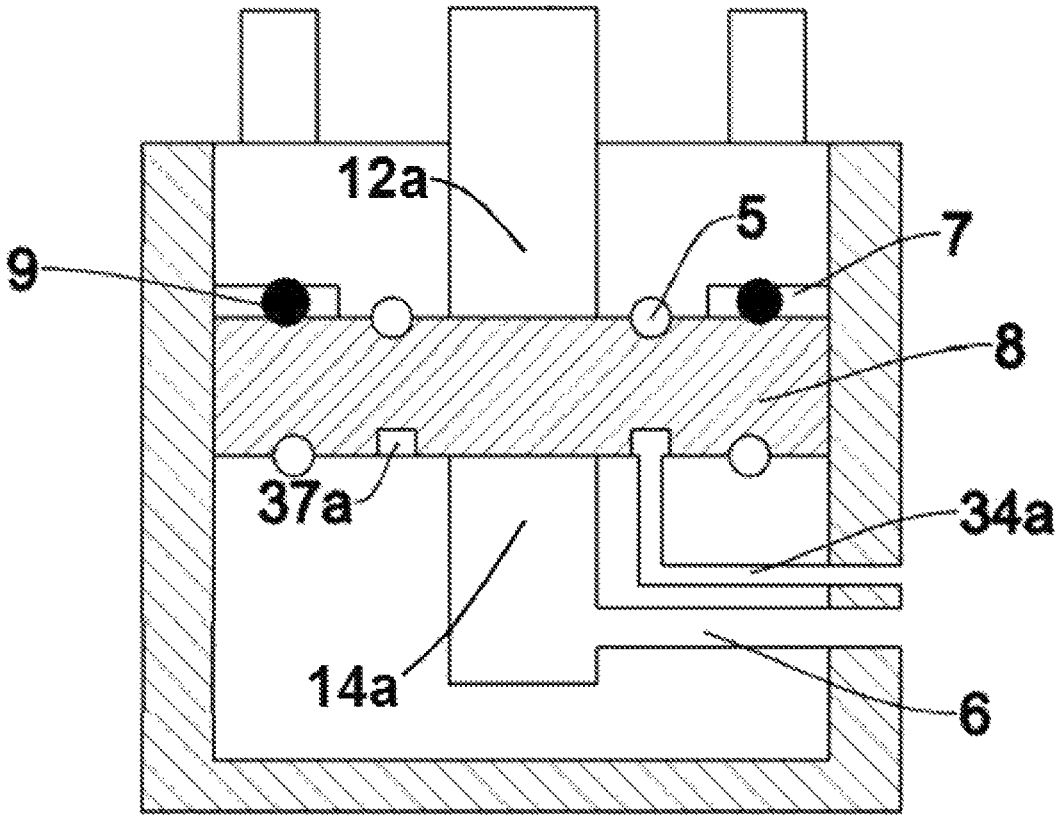
FIG. 9 shows a schematic cross-sectional view of a fine blanking device in accordance with one embodiment of the present invention.

In addition, according to certain embodiments of the present invention, a sheet stock trough 37*a* may be formed on a sheet stock 8 (as shown in FIGS. 8 and 9), relatively to a trough structure 7. As shown in FIGS. 8 and 9, for a fine blanking device of the present invention with a sheet stock trough 37*a* formed on the top or bottom side of the sheet stock 8, a hydraulic pressure may be applied to the sheet stock troughs 37*a* from an oil pressure inlet 32*a* or 34*a*. Similarly, a back pressure module 6, a means for sealing 5, and/or a filler module 9 may be further included.

It is believed that a person of ordinary knowledge in the art where the present invention belongs can utilize the present invention to its broadest scope based on the descriptions herein with no need of further illustration. Therefore, the descriptions and claims as provided should be understood as of demonstrative purpose instead of limitative in any way to the scope of the present invention.

I claim:

1. A fine blanking device for blanking a sheet stock, comprising:

a punch having cutting edges;

a mother die module having a first die cavity defined by a first sidewall;

a blank-holder module having a second die cavity defined by a second sidewall, both the first and second die cavities allowing the punch to enter therein; and a die holder with a cavity defined by a third sidewall, wherein a first trough structure is formed, surrounding the second die cavity, on the blank-holder module at a sheet stock contacting side thereof, thereby increasing a pressure exerted on the sheet stock by the blank-holder module at the area around the cutting edges of the punch when the blank-holder module presses on the sheet stock and the punch cuts the sheet stock, the first trough being recessed, away from the mother die module, from said sheet stock contacting side of the blank-holder module, and extending, in a radial direction extending from a central axis of the punch, from a position distanced from the second sidewall of the second die cavity to an outer sidewall of the blank-holder module, and wherein the cavity of the die holder accommodates the blank-holder module and the mother die module with the third sidewall directly contacting the outer sidewall of the blank-holder module and an outer sidewall of the mother die module, and the third sidewall continuously extends from the blank-holder module to a point beyond the sheet stock contacting side of the blank-holder module in a direction toward the mother die module, thereby enclosing the first trough structure.

2. The fine blanking device as claimed in claim 1, further comprising a second trough structure formed on the mother die module, wherein the second trough structure is formed, surrounding the first die cavity, on the mother die module at a sheet stock contacting side thereof, thereby increasing a pressure exerted on the sheet stock by the mother die module at the area around the cutting edges of the punch when the blank-holder module presses on the sheet stock and the punch cuts the sheet stock, the second trough being recessed, away from the blank-holder module, from said sheet stock contacting side of the mother die module, and extending, in the radial direction extending from a central axis of the punch, from a position distanced from the first sidewall of the first die cavity to the outer sidewall of the mother die module.

3. The fine blanking device as claimed in claim 1, further comprising a V-shaped ring disposed, relatively to the first trough structure, on the mother die module, wherein the V-shaped ring is disposed, surrounding the first die cavity, on the mother die module at a sheet stock contacting side thereof.

4. The fine blanking device as claimed in claim 1, further comprising a sealing member disposed between the sheet stock and the mother die module and/or the sheet stock and the blank-holder module.

5. The fine blanking device as claimed in claim 1, further comprising a back pressure module for generating a back pressure, the back pressure acting on a bottom side of the sheet stock.

6. The fine blanking device as claimed in claim 1, wherein the first trough structure further includes a filler module disposed therein.

7. A fine blanking device for blanking a sheet stock, comprising:

a punch having cutting edges;

a mother die module having a first die cavity, defined by a first sidewall, allowing the punch to enter therein;

a blank-holder module having a second die cavity, defined by a second sidewall, allowing the punch to enter therein; and a die holder with a cavity defined by a third sidewall, wherein a first trough structure is formed on the blank-holder module, wherein the first trough structure is formed, surrounding the second die cavity, on the blank-holder module at a sheet stock contacting side thereof, thereby increasing a pressure exerted on the sheet stock by the blank holder module at the area around the cutting edges of the punch when the blank-holder nodule presses on the sheet stock and the punch cuts the sheet stock, the first trough being recessed, away from the mother die module, from said sheet stock contacting side of the blank-holder module, and extending, in a radial direction extending from a central axis of the punch, from a position distanced from the second sidewall of the second die cavity to an outer sidewall of the blank-holder module, wherein a second trough structure is formed on the mother die module, wherein the second trough structure is formed, surrounding the first die cavity, on the mother die module at a sheet stock contacting side thereof, thereby increasing a pressure exerted on the sheet stock the mother die module at the area around the cutting edges of the punch when the blank-holder module presses on the sheet stock and the punch cuts the sheet stock, the second trough being recessed, away from the blank-holder module, from said sheet stock contacting side of the mother die module, and extending, in the radial direction extending from the central axis of the punch, from a position distanced from the first sidewall of the first die cavity to an outer sidewall of the mother die module, wherein the first trough structure is aligned with the second trough structure, the cavity of the die holder accommodates the blank-holder module and the mother die module with the third sidewall directly contacting the outer sidewall of the blank-holder module and the outer sidewall of the mother die module, and wherein the third sidewall continuously extends from the blank-holder module to a point beyond the sheet stock contacting side of the blank-holder module in a direction toward the mother die module, and continuously extends from the mother die module to a point beyond the sheet stock contacting side of the mother die module in a direction toward the blank-holder module, thereby enclosing the first trough structure and the second trough structure.

8. The fine blanking device as claimed in claim 7, further comprising a V-shaped ring disposed, relatively to the first trough structure, on the mother die module, wherein the V-shaped ring is disposed, surrounding the first die cavity, on the mother die module at a sheet stock contacting side thereof.

9. The fine blanking device as claimed in claim 7, further comprising a sealing member disposed between the sheet stock and the mother die module and/or the sheet stock and the blank-holder module.

10. The fine blanking device as claimed in claim 7, further comprising a back pressure module for generating a back pressure, the back pressure acting on a bottom side of the sheet stock.

11. The fine blanking device as claimed in claim 7, wherein the first trough structure further includes a filler module disposed therein.

* * * * *